United States Patent [19]

Strauch

[11] Patent Number: 4,817,318

[45] Date of Patent: Apr. 4, 1989

[54] DEMOUNTABLE ROAD SIGN

[76] Inventor: C. Randolph Strauch, 934 Rogers St., Bucyrus, Ohio 44820

[21] Appl. No.: 30,119

[22] Filed: Mar. 26, 1987

[51] Int. Cl.[4] ..... G09F 7/02

[52] U.S. Cl. ..... 40/610; 40/514; 40/612; 38/70

[58] Field of Search ..... 40/584, 606, 607, 610, 40/112; 38/70

[56] References Cited

U.S. PATENT DOCUMENTS

| | | | |
|---|---|---|---|
| 2,887,983 | 5/1959 | Budd | 40/602 |
| 4,059,915 | 11/1977 | Owens | 40/602 |
| 4,171,585 | 10/1979 | Macuka | 40/602 |
| 4,292,751 | 10/1981 | Snyder | 40/617 |
| 4,694,601 | 9/1987 | Dicke et al. | 40/610 |

FOREIGN PATENT DOCUMENTS

| | | | |
|---|---|---|---|
| 674225 | 4/1939 | Fed. Rep. of Germany | 40/517 |

*Primary Examiner*—John Weiss
*Assistant Examiner*—Wenceslao J. Contreras
*Attorney, Agent, or Firm*—Willian Brinks Olds Hofer Gilson & Lione

[57] ABSTRACT

A demountable road sign intended primarily for transient utilization includes a collapsible ground engaging support, a pivoted pantograph-type frame and a rolled, self-storing sign. The support preferably includes an elongate rod or similar structure which may be maintained in a vertical orientation by a plurality of attached legs. The legs are movable from a stored position generally adjacent the elongate rod to a deployed position in which they extend uniformly and obliquely away from the rod and engage the ground. Suitable structures for receiving the elongate rod support and securing the frame thereto form a portion of the frame. The frame includes a pair of preferably equal length arms pivotally interconnected at their mid points and a sign receiving device disposed on one end of each arm. The ends of the arms are interconnected by a pair of shorter pivoted arms. The sign is a flexible panel having indicia appearing on one or both sides which is furled on a spring-biased roller disposed within a protective elongate housing. The housing is received within the sign receiving devices and the sign deployed across the open frame where it is retained by engagement with suitable clips.

21 Claims, 3 Drawing Sheets

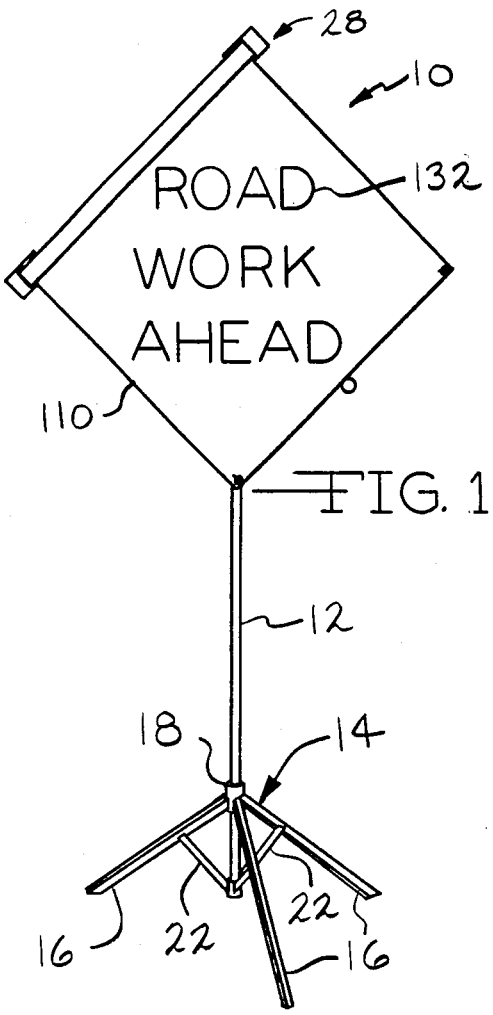
FIG. 1
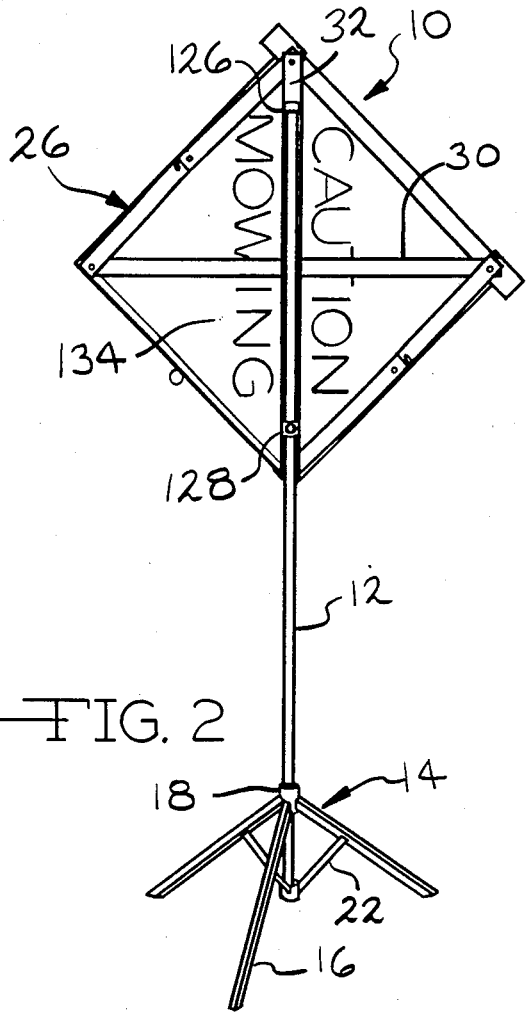
FIG. 2
FIG. 3
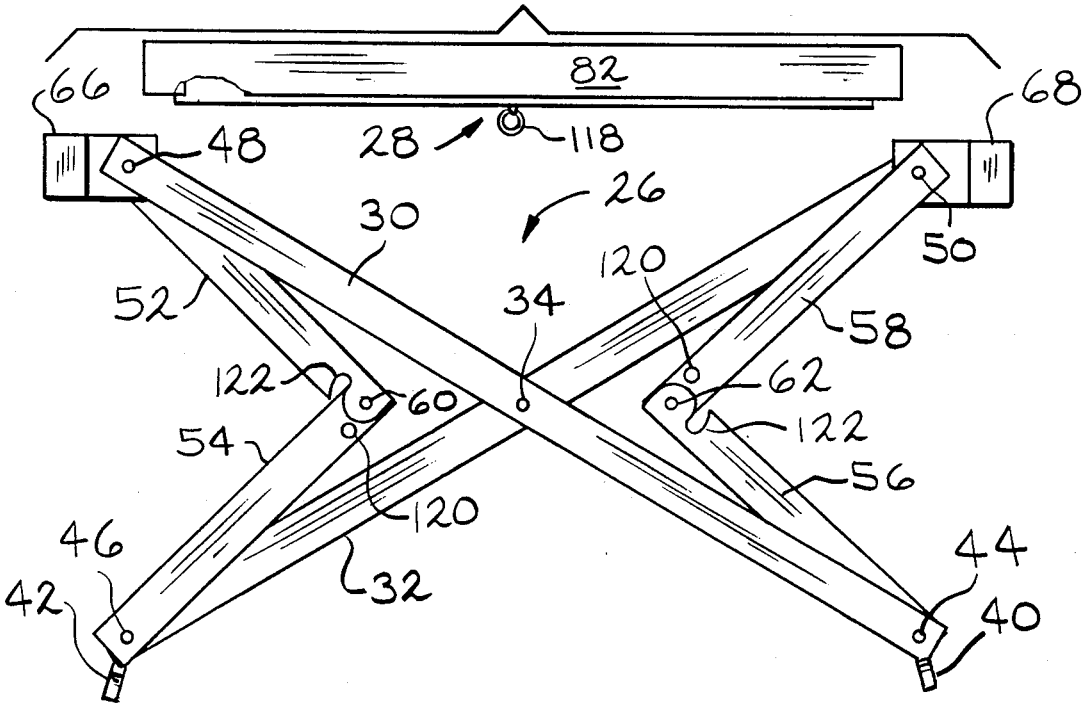

DEMOUNTABLE ROAD SIGN

BACKGROUND OF THE INVENTION

The invention relates generally to road signs and more specifically to portable and readily demountable road signs which may be used on a transient or short term basis.

As long as vehicles have been disabled and as early as roadways have required repair, signs and placards to warn approaching motorists have existed. In the former instance, such warning signs frequently took the form of flares or the current standard triangular reflective sign. In the latter instance, the variety of situations is reflected in the variety of sign configurations. Perhaps the most standard design is a solid panel of metal or wood typically three to four feet square. The sign is painted a brilliant color and includes indicia in one face. Support for the sign may be one of an equally large variety of designs such as single staffs having flared bases or easel-like supports.

A typical sign and support is illustrated in U.S. Pat. No. 3,165,847. Here, a rigid panel is suspended generally between a pair of aligned, U-shaped frames interconnected at their bases by pairs of pivoted arms. While this portable sign folds to a generally flat, two dimensional arrangement for storage, it still occupies a significant volume.

Another demountable sign is taught in U.S. Pat. No. 3,899,843. A sign formed of flexible material is supported by a pair of centrally pivoted arms. The sign is yieldably supported to facilitate spilling of the wind past the sign. The support disclosed is readily collapsible into a substantially one dimensional package. The sign, since it is fabricated of a material such as canvas, may likewise be stored in a substantially one dimensional package. However, no means are disclosed whereby the sign may be so maintained or protected from dirt or other deleterious influences.

From the foregoing, it is apparent that improvements in the art of demountable signs and road warning apparatus are both desirable and possible.

SUMMARY OF THE INVENTION

The present invention is directed to a demountable road sign which comprises a collapsible, ground engaging support, a pivoted, pantograph-type frame and a rolled, self-storing sign. The demountable road sign according to the present invention is intended primarily for temporary or transient use at work sites involving road repairs, mowing or other roadway adjacent activities by highway department and utility personnel.

The ground engaging support preferably includes an elongate rod or similar extensible structure which may be maintained in a vertical orientation by a plurality of attached legs. The legs are moveable from a stored position generally adjacent the elongate rod to a deployed position in which they extend obliquely away from the rod at a common angle. The ends of the legs opposite the elongate rod engage the ground.

The frame includes a pair of preferably equal length arms pivotally interconnected at their mid points. A sign receiving cup is disposed at one end of each of the pair of arms. At least one of the cups includes a spring. The ends of the pair of arms are pivotally interconnected by a respective pair of two pairs of shorter arms which are likewise pivotally interconnected. Stop structures adjacent the pivots of the shorter pairs of arms prevent the frame from being opened improperly as well as maintain it in its open position. The frame also includes suitable means for receiving the elongate support rod and for securing the frame thereto.

The sign itself is preferably a flexible panel which may be a woven fabric or solid (non-woven) material which is stored in a wound position upon a spring biased roller. The roller is rotatably mounted within an elongate protective enclosure defining an elongate slot through which the sign may be extended and retracted. The elongate sign containing enclosure is received within the sign receiving cups of the frame. So received, the sign may be conveniently deployed by drawing it across the frame and retaining it in the displayed position by engagement with suitable clips disposed on the frame.

Thus it is an object of the present invention to provide a demountable road sign comprising a collapsible stand, a pivoting, pantograph-type frame and a self-storing rolled sign.

It is a further object of the present invention to provide a demountable road sign wherein the sign is self stored and protected upon a spring biased roller disposed within an elongate enclosure.

It is a still further object of the present invention to provide a demountable road sign in which the components may be collapsed into substantially one dimensional packages.

It is a still further object of the present invention to provide a demountable road sign wherein the sign may be fabricated of an open weave fabric which provides minimal wind resistance.

It is a still further object of the present invention to provide a demountable road sign wherein a single sign panel may include two distinct messages or symbols on opposed surfaces of the sign panel.

Further objects and advantages of the present invention will become apparent by reference to the following description of the preferred embodiment and appended drawings.

BRIEF DESCRIPTION OF THE DRAWINGS

FIG. 1 is a front perspective view of a demountable road sign according to the present invention;

FIG. 2 is a rear perspective view of a demountable road sign according to the present invention;

FIG. 3 is a top plan view of the pantograph frame and sign enclosure of the demountable road sign according to the present invention;

DESCRIPTION OF THE PREFERRED EMBODIMENT

Figure 4:
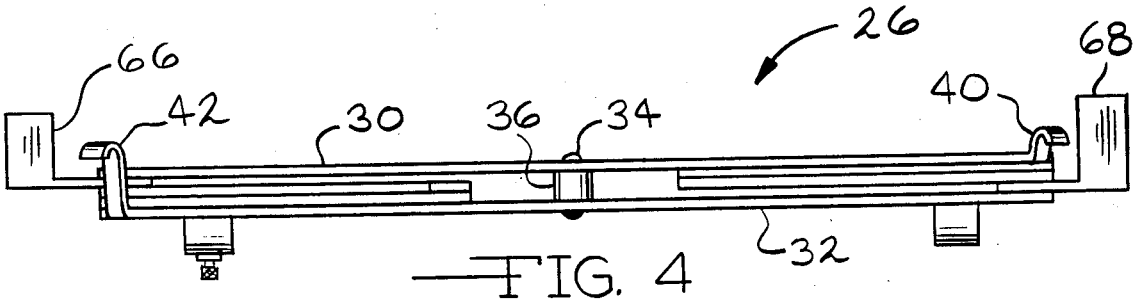
FIG. 4 is a side elevational view of the pantograph frame of a demountable road sign according to the present invention.

Referring now to FIGS. 1 and 2, a demountable road sign in accordance with the present invention is illustrated and generally designated by the reference numeral 10. The demountable road sign 10 generally includes a vertically oriented and maintained support structure such as a rod or post 12. The post 12 is preferably supported by a collapsible tripod-type base assembly 14. The tripod assembly 14 comprises three legs 16 which are pivotally secured to a collar 18 which slidingly receives the post 12. The tripod assembly 14 also includes three hinge bars 22 which are pivotally secured to the legs 16 and to the lower extremity of the post 12. A releasable member such as a pin or set screw (not illustrated) maintains the collar 18 in the position illustrated in FIGS. 1 and 2 or permits axial motion of the collar 18 along the post 12 to collapse the tripod assembly 14. It will be appreciated that the tripod assembly 14 functions in a conventional manner and is selectively utilized to maintain the post 12 in an upright position as will be readily understood. The demountable road sign 10 further includes a pantograph frame assembly 26 and a sign assembly 28.

Referring now to FIGS. 2, 3 and 4, the pantograph frame assembly 26 includes a first pair of preferably equal length longer arms 30 and 32 which are pivotally secured at their mid points by a suitable pivot pin 34. Preferably, a spacer 36 having a diameter larger than the diameter of the pivot pin 34 is disposed between the opposed faces of the longer arms 30 and 32 and maintains them in spaced relationship. One end of the arm 30 is formed into or includes a clip or hook 40 and one end of the arm 32 is likewise formed into or includes a clip or hook 42. The height of the clips 40 and 42 above the upper or outer face of the first arm 30 is preferably equal as illustrated in FIG. 4. The clips 40 and 42 are oriented at an angle of approximately 45° to the longitudinal axis of the respective arms 30 and 32 such that when the frame 26 is open as illustrated in FIG. 1, the clips 40 and 42 are substantially parallel.

At the ends of the first pair of arms 30 and 32 and adjacent the clips 40 and 42 is a respective pivot pin 44 and 46. Likewise, at the opposite ends of the first pair of arms 30 and 32 (opposite the clips 40 and 42) are additional respective pivot pins 48 and 50. The pivot pins 46 and 48 pivotally interconnect ends of the first pair of arms 30 and 32 with a first pair of shorter arms 52 and 54, respectively. Likewise, the pivot pins 44 and 50 interconnect the opposite ends of the first pair of arms 30 and 32 with a second pair of shorter arms 56 and 58, respectively. The first pair of shorter arms 52 and 54 are likewise pivotally interconnected by a pivot pin 60 and the second pair of shorter arms 56 and 58 are interconnected by a pivot pin 62. The first pair of arms 30 and 32 and pairs of shorter arms 52 and 54 and 56 and 58 thus form a pantograph-type arrangement which may be deployed into the generally rectangular configuration illustrated in FIG. 2 or collapsed through the position illustrated in FIG. 3 into the aligned and stacked position illustrated in FIG. 4 which represents the stored position of the pantograph frame assembly 26. At the intersection of the longer arm 30 and one of the shorter arms 52 and pivotally secured thereto by the pivot pin 48 is a first end member 66. Likewise, at the intersection of the other longer arm 32 and one of the shorter arms 58, and pivotally secured thereto by the pivot pin 50 is a second end member 68. The end members 66 and 68 may define a square, rectangular or circular cross section, as desired. Alternatively, the end members 66 and 68 may be integrally formed with or fixedly secured to the longer arms 30 and 32 or shorter arms 52 and 58. However, minimum stowed size of the pantograph frame assembly 26 will not result if fixed end members are utilized.

Figure 5:
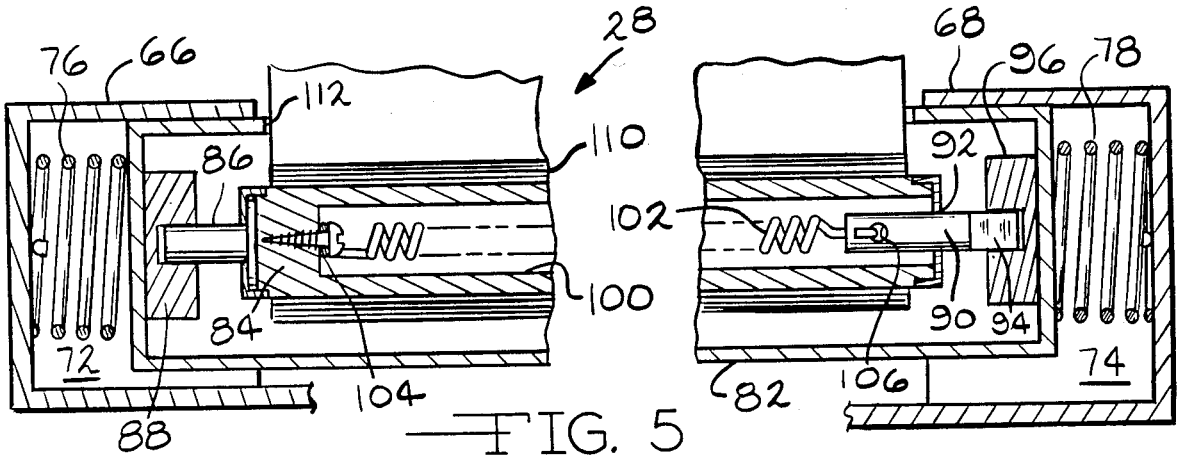
FIG. 5 is an enlarged, fragmentary, full sectional view of the sign enclosure of a demountable road sign according to the present invention.

Referring now to FIG. 5, the first end member 66 and the second end member 68 are hollow and define a relatively deep reentrant region 72 and 74 which is sized to receive the ends of the sign assembly 28 as illustrated. Disposed within the reentrant regions 72 and 74 and arranged to provide a biasing force toward the open end of the end members 66 and 68 are a pair of compression springs 76 and 78, respectively. As illustrated the springs 76 and 78 are coil compression springs but other spring designs such as leaf springs or other material providing compressive forces are also suitable.

In a deployed position, the sign assembly 28 is received within the end members 66 and 68 as illustrated and securely received there due to the biasing force supplied to both ends of the sign assembly 28 by the compression springs 76 and 78. The frame members may be fabricated of aluminum, steel or high impact plastics such as acrylonitrile-butadiene-styrene (ABS) and similar relatively strong, lightweight materials.

The sign assembly 28 includes an elongate housing 82 having an open interior space within which is received a similarly elongate roller 84. The housing 82 may define a square, rectangular or circular cross section, as desired, but is preferably complementary to the cross section of the end members 66 and 68. The roller 84 is supported for rotation upon a pair of stub shafts. The first stub shaft 86 is secured to the roller 84 and rotates with it. The first stub shaft 86 is received within a journal bearing 88 secured to the inside of the elongate housing 82. A second stub shaft 90 at the opposite end of the roller 84 is rotatably received within a bushing 92 secured to the end of the roller 84 and includes opposed flats 94 which are received within a complementary structure such as a slotted aperture of a mounting block 96 which is secured to the inside of the elongate housing 82. The stub shaft 90 therefore does not rotate relative to the housing 82. The roller 84 defines an elongate cylindrical chamber 100. Axially disposed within the chamber 100 is a coil spring 102. One end of the coil spring 102 is secured to the roller 84 by a suitable fastening means such as a wood or machine screw 104. The other end of the coil spring 102 is received within an aperture 106, or secured by other suitable means, to the stub shaft 90. Thus the coil spring 102 provides rotational bias to the roller 84 in a manner similar to the spring in a window shade. It should be understood, however, that no catch or latch means is included in the present device and that the rotational bias provided by the spring 102, once the roller 84 has been rotated to tension the spring 102, will be constantly applied to the roller 84. Secured to the outer surface of the roller 84 and wrapped thereabout when stored is a flexible sign 110. The housing 82 also defines an elongate slot 112 which is slightly longer than the width of the sign 110 through which the flexible sign 110 may pass.

Figure 6:
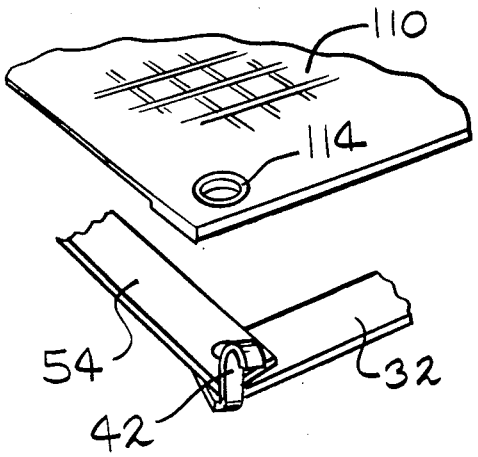
FIG. 6 is a fragmentary perspective view of portions of the sign and pantograph frame of a first embodiment.

Referring now to FIG. 6, it will be appreciated that the sign 110 may be a solid material such as heavy gauge polyethylene, or similar plastic material having good strength as well as flexibility at low temperatures, canvas, or an open weave fabric such as illustrated to minimize the wind resistance of the deployed sign. At each corner of the sign 110 farthest from the housing 82 when the sign 110 is extended therefrom is a eyelet or grommet 114, one of which is illustrated in FIG. 6. The grommet 114 is of a internal diameter sufficiently large to receive a corresponding one of the clips or hooks 40 and 42. It will therefore be appreciated that the sign 110 may be maintained in the open position illustrated in FIGS. 1 and 2 by engaging the grommets 114 in the clips 40 and 42 of the open frame assembly 26.

Figure 7:
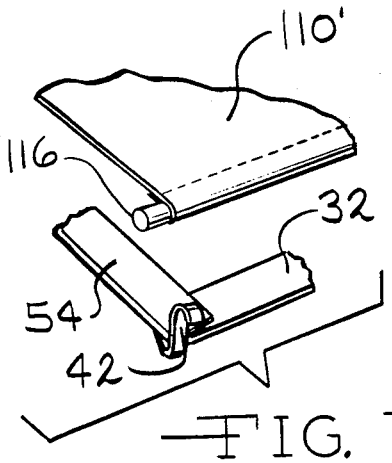
FIG. 7 is a fragmentary perspective view of portions of the sign and pantograph frame of an alternate embodiment.

Referring now to FIG. 7, an alternate configuration 110' of the sign 110 is illustrated. Here, an alternate embodiment sign 110' includes a bar or rod 116 of fiberglass, aluminum or other similar material preferably having a circular cross section which extends beyond the edge of the sign 110'. The bar or rod 116 may be received within a suitable sewn or otherwise secured passageway in an end adjacent region of the sign 110'. The portion of the bar or rod 116 which extends beyond the sign 110' may therefore readily be positioned and maintained within the clips 40 and 42 to maintain the sign 110' in a deployed position as will be readily understood. The first embodiment sign 110 or the alternate embodiment sign 110' may include a ring 118 (illustrated in FIG. 3) which is secured to the marginal edge of the sign 110 or 110' at its mid point. The ring 118 facilitates deployment of the sign 110 or 110' from the housing 82.

Figure 8:
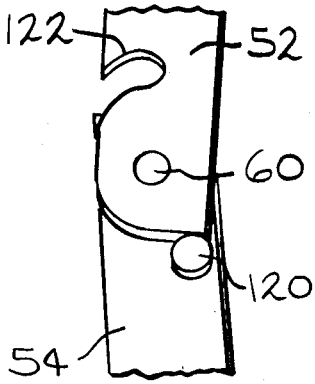
FIG. 8 is a fragmentary perspective view of one of the pair of stop structures of the pantograph frame.

Referring now to FIG. 8, it will be appreciated that the pivotally interconnected pairs of shorter arms 52 and 54 and 56 and 58 include means for maintaining them in an open and deployed position as illustrated in FIG. 2 as well as preventing opening of the pantograph frame assembly 26 in a reverse manner. Such means includes a pin 120 so positioned as to inhibit motion of the shorter pairs of arms relative to one another beyond a predetermined angular relationship. The open and deployed position and the angular relationship of the components of the frame assembly 26 is generally illustrated in FIG. 2 and represents an outwardly bowed, over-center position. The frame assembly 26 is maintained in this position by the forces generated by the compression springs 76 and 78 in cooperation with the housing 82 as noted above. When the pantograph frame assembly 26 is collapsed, through the position illustrated in FIG. 3, to the position illustrated in FIG. 4, an arcuate channel 122 in the arms 52 and 56 receives the stop pin 120. As such, it prevents opening of the arms of the pantograph frame assembly 26 in an opposite manner and thus ensures that the pantograph frame assembly 26 when deployed will be properly arranged.

Figure 9:
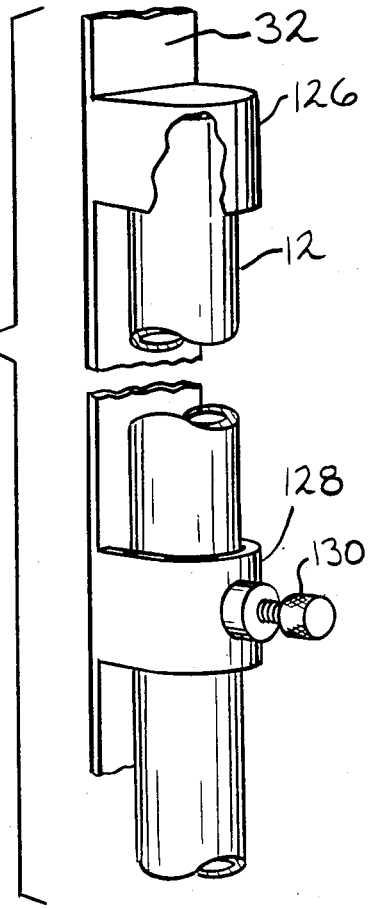
FIG. 9 is a fragmentary perspective view of rear portions of the pantograph frame and support receiving structures.

Referring now to FIG. 9, the lower one of the longer pivoted arms, the arm 32 which is disposed in an upright position as illustrated in FIG. 2 includes a reentrant cap 126 which receives the upper end of the post 12. Positioned at the generally lower portion of the arm 32 is open collar 128 having a set screw or similar securement means 130 which may be securely tightened to the post 12 thereby securing the pantograph frame assembly 26 to the post 12. Lastly, it will be appreciated that the flexible sign 110 includes indicia 132 on one face and distinct indicia 134 on its opposite face. Two distinct sign messages may therefore be available with but a single sign 110, conveniently reducing the necessary inventory of signs.

Figure 10:
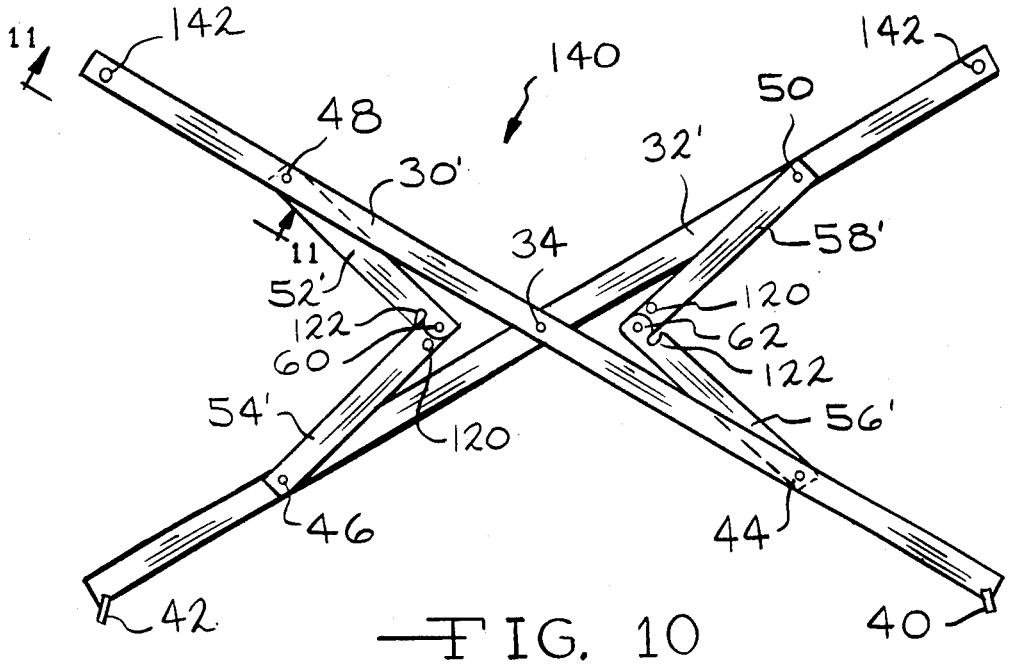
FIG. 10 is a top plan view of an alternate embodiment pantograph frame.

Referring now to FIG. 10, an alternate embodiment pantograph frame assembly 140 is illustrated. As will be apparent, it is generally similar to the preferred embodiment pantograph frame assembly 26 illustrated in FIG. 3. As such, it includes a first pair of preferably equal length longer arms 30' and 32' which are pivotally secured at their mid points by a suitable center pivot pin 34. A spacer 36 (illustrated in FIG. 4) maintains the arms 30' and 32' in spaced relationship. One end of the arm 30' is formed into or includes a clip or hook 40 and one end of the arm 32' is likewise formed into or includes a clip or hook 42.

Disposed at any convenient location along the arm 30' between the center pivot pin 34 and the clip 40 is a pivot pin 44 and similarly disposed on the arm 32' is a pivot pin 46. Disposed preferably at a distance from the center pivot pin 34 equal to the distance between the center pivot pin 34 and the pivot pin 44 on the arm 32' is a pivot pin 50. And disposed at a distance from the center pivot pin 34 equal to the distance between the center pivot pin 34 and the pivot pin 46 on the arm 30' is a pivot pin 48. A first pair of shorter arms 52' and 54' which are pivotally interconnected by a pivot pin 60 are pivotally connected to the arms 30' and 32' by the pivot pins 48 and 46, respectively. Similarly, a second pair of shorter arms 56' and 58' which are pivotally interconnected by the pivot pin 62 are pivotally connected to the arms 30' and 32' by the pivot pins 44 and 50, respectively. Each of the pairs of shorter arms includes the stop pin 120 and arcuate channel 122 which provide the same functions described above with reference to the preferred embodiment. It will be appreciated that the alternate embodiment pantograph frame assembly 140 is similar in construction and identical in operation to the preferred embodiment pantograph frame assembly 26 but that it comprehends shorter pairs of arms 52' and 54' and 56' and 58' which are shorter in length and thus require less material and are therefore less costly than those of the assembly 26 described above.

Figure 11:
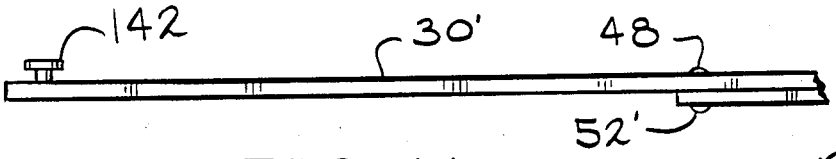
FIG. 11 is a fragmentary side elevational view of a portion of the alternate embodiment pantograph frame taken along line 11—11 of FIG. 10.

Referring now to FIGS. 10 and 11, at the ends of the arms 30' and 32' opposite the clips 40 and 42, respectively, is a stanchion or stud 142 having an enlarged diameter head region and reduced diameter shank region.

Figure 12:
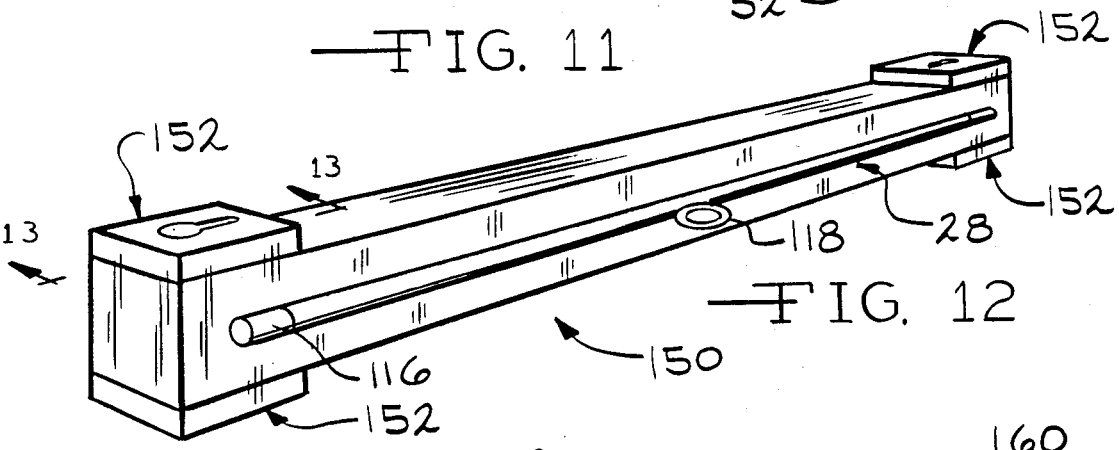
FIG. 12 is a perspective view of an alternate embodiment sign enclosure.
Figure 13:
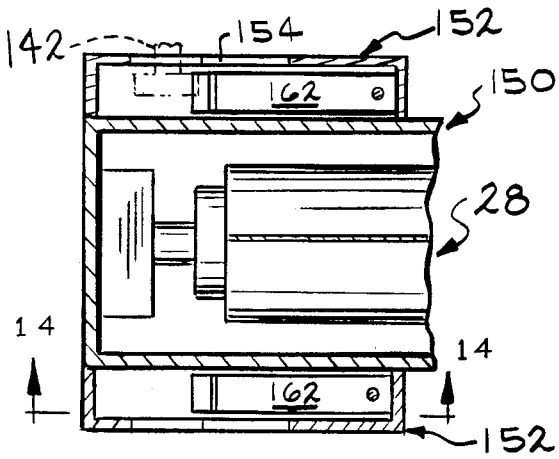
FIG. 13 is an enlarged, fragmentary sectional view of an alternate embodiment sign enclosure taken along line 13—13 of FIG. 12.
Figure 14:
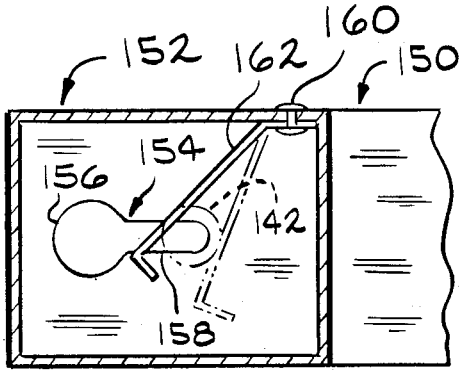
FIG. 14 is an enlarged, fragmentary sectional view of a portion of the alternate embodiment sign and enclosure taken along line 14—14 of FIG. 13.

Referring now to FIGS. 12, 13 and 14, an alternate embodiment elongate housing 150 is illustrated. The elongate housing 150 is preferably square in cross section though it may be circular or hexagonal, for example, if desired. The elongate housing 150 contains and protects a sign assembly 28 which is identical to that described above in connection with the preferred embodiment. The housing 150 defines a pair, if the flexible sign 110 is single-sided, and two pair, if the flexible sign 110 is double-sided, of mounting assemblies 152 which cooperate with the studs or stanchions 142 on the arms 30' and 32'. The mounting assemblies 152 define a keyhole slot arrangement 154 which extends through the outer surface of the mounting assembly 152. The keyhole slot arrangement 154 defines a generally circular aperture 156 having a diameter slightly larger than the head of the stud or stanchion 142 and a radially oriented narrow slot 158 which is slightly larger in width than the reduced diameter region of the stud or stanchion 142. Secured to the mounting assembly 152 by any suitable means such as a rivet 160 is a leaf spring 162. The leaf spring 162 is positioned to bias the stanchion 142 toward the aperture 156 as illustrated in FIG. 14. The leaf spring 162 thus provides outward bias to the studs or stanchions 142 disposed on the arms 30' and 32' and maintains force on the pairs of shorter arms 52' and 54' and 56' and 58' in the over center position illustrated in FIG. 2 in a manner similar to the compression springs 76 and 78 contained within the end members 66 and 68.

It will be appreciated that the alternate embodiment elongate housing 150 and the mounting assembly 152 provide a somewhat more compact overall demountable sign assembly in that the end members 66 and 68 are eliminated. It should furthermore be appreciated that the utilization of the shorter pairs of arms 52' and 54' and 56' and 58' illustrated in FIG. 10 may be readily utilized with the end members 66 and 68 as illustrated in FIG. 3, and that other preferred and alternate embodiment elements may be readily interchanged and combined, if desired. Finally, it should be understood that while both the preferred and alternate embodiment pantograph frame assemblies 26 and 140 have been described as including two pairs of shorter arms, a single pair of the shorter arms will function properly and provide all necessary mechanical actions.

In view of the foregoing, it will be appreciated that a demountable sign according to the present invention provides many advantages. The flexible sign 110 is stored in the housing 82 when it is not in use thereby protecting it from dirt, grease and other harmful substances. The frame 26 collapses to a small, substantially one-dimensional package about equal in size to the sign assembly 28. The sign 110 may readily include two distinct messages on opposite faces. The demountable sign according to the present invention may be quickly deployed and just as quickly disassembled for transport and storage.

The foregoing disclosure is the best mode devised by the inventor for practicing this invention. It is apparent, however, that apparatus incorporating modifications and variations will be obvious to one skilled in the art of supports and signs. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. In a demountable road sign having a ground engaging support including a base structure and an intermediate support structure, the improvement comprising, a frame having a pair of longer arms pivotally interconnected at their mid points, a sign housing engaging member at one end of each of said longer arms, spring means for providing biasing force to said frame, a pair of pivotally interconnected shorter arms, one end of one of said pair of shorter arms pivotally connected to said one end of one of said longer arms and one end of the other of said pair of shorter arms pivotally connected to the end opposite said one end of the other of said longer arms, a sign housing defining sign panel receiving opening and a rotationally biased roller disposed for rotation within said housing having a sign panel affixed thereto whereby said housing may be engaged by said sign housing engaging members and said sign panel extended across said frame.

2. The improvement of claim 1 wherein said housing engaging members each include said spring means.

3. The improvement of claim 1 wherein said spring means is a coil compression spring.

4. The improvement of claim 1 further including stop means disposed on one of said shorter arms for maintaining said frame in an open position.

5. The improvement of claim 4 further including a channel cooperating with said stop means to inhibit reverse opening of said frame.

6. The improvement of claim 1 wherein said frame further includes clip means disposed on said frame for maintaining said sign panel in a extended position across said frame.

7. The improvement of claim 1 wherein said sign panel includes a rod secured adjacent a marginal edge of said sign panel and extending beyond the adjacent perpendicular marginal edges of said sign panel.

8. The improvement of claim 1 wherein said roller defines a chamber and includes a torsion spring disposed in said chamber.

9. The improvement of claim 1 wherein said sign panel further includes indicia on each face.

10. The improvement of claim 1 further including a second pair of pivotally interconnected shorter arms pivotally interconnecting the other end of each of said longer arms.

11. The improvement of claim 1 wherein said housing engaging means is a stanchion and further including a pair of shaped apertures on said sign housing for receiving said stanchion.

12. A demountable road sign comprising, in combination, a frame including a pair of longer arms pivotally interconnected at their mid points, a sign receiving member disposed on one end of each of said arms, a spring disposed within at least one of said sign receiving members, at least one pair of pivotally interconnected shorter arms, one end of one of said pair of shorter arms pivotally connected to said one end of one of said longer arms and one end of the other of said pair of shorter arms pivotally connected to the end opposite said one end of the other of said longer arms, stop means disposed on one of said shorter arms for maintaining said frame in an open position, an elongate housing defining a sign panel receiving opening, and a rotationally biased roller disposed for rotation within said housing having a sign panel affixed thereto whereby said housing may be disposed within said signal receiving members and said sign panel extended across said frame.

13. The demountable road sign of claim 12 wherein said sign receiving members each include a coil compression spring.

14. The demountable road sign of claim 12 further including a channel cooperating with said stop means for inhibiting reverse opening of said frame.

15. The demountable road sign of claim 12 wherein said roller defines a chamber and includes a torsion spring disposed in said chamber.

16. The demountable road sign of claim 12 further including clip means coupled to said frame for receiving and maintaining said sign panel in an open position and means on said sign panel for cooperating with said clip means.

17. A demountable road sign comprising, in combination, a collapsible ground engaging support, a pivoted frame and a self-storing sign, a frame including a pair of substantially equal length arms pivotally interconnected at their mid points, a sign receiving member disposed on one end of each of said arms, a spring disposed within at least one of said sign receiving members, a first pair of pivotally interconnected shorter arms pivotally interconnecting one end of each of said equal length arms, a second pair of pivotally interconnected shorter arms pivotally interconnecting the other end of each of said equal length arms and an elongate housing defining a slot, a rotationally biased roller supported for rotation within said housing having a sign panel affixed thereto whereby said housing may be disposed within said sign receiving members and said sign panel extended across said frame.

18. The demountable road sign of claim 17 wherein said ground engaging support includes an elongate member maintained in a substantially vertical orientation by a plurality of legs movable from a stored position generally adjacent said elongate member to a deployed position extending obliquely away from said elongate member.

19. The demountable road sign of claim 17 further including at least one stop member disposed on one of said pair of pivotally interconnected shorter arms to maintain said frame in an open position.

20. The demountable road sign of claim 17 wherein said spring is a compression spring.

21. The demountable road sign of claim 17 further including clip means disposed on said frame for maintaining said sign panel across said frame.

* * * * *